US005657999A

United States Patent [19]

Beaulieu

[11] Patent Number: 5,657,999

[45] Date of Patent: Aug. 19, 1997

[54] IN-LINE ROLLER BLADE BRAKING DEVICE

[76] Inventor: Noel Beaulieu, 155 Themens, Apt. 5, St-Jerome, Quebec, Canada, J7Y 3C5

[21] Appl. No.: 504,707

[22] Filed: Jul. 20, 1995

[51] Int. Cl.[6] ..... A63C 17/14

[52] U.S. Cl. ..... 280/11.2; 280/11.22

[58] Field of Search ..... 280/11.2, 11.22, 280/11.23, 11.21, 11.19; 188/17, 24.12, 24.13, 24.15, 25.16, 26, 29.76

[56] References Cited

U.S. PATENT DOCUMENTS

| | | | |
|---|---|---|---|
| 5,142,387 | 8/1992 | Colla | 280/11.2 |
| 5,251,934 | 10/1993 | Gates | 280/11.2 |
| 5,335,924 | 8/1994 | Richards | 280/11.2 |
| 5,374,071 | 12/1994 | Johnson | 280/11.2 |
| 5,388,844 | 2/1995 | Pellegrini | 280/11.2 |
| 5,403,021 | 4/1995 | Shifrin | 280/11.2 |

FOREIGN PATENT DOCUMENTS

| | | | |
|---|---|---|---|
| 93020912 | 10/1993 | WIPO | 280/11.22 |

*Primary Examiner*—Anne Marie Boehler
*Attorney, Agent, or Firm*—Eric Fincham

[57] ABSTRACT

There is provided a braking system for in-line roller skates wherein a moveable pressure plate is mounted in the toe portion of the skate such that downward pressure exerted by the toes of the skate will, through an interconnecting member, activate caliper brakes on one or more of the wheels. A device for adjusting the sensitivity of the brake to prevent accidental engagement is preferably provided. The system allows a controlled braking action on the wheels while both feet remain in a stable position.

9 Claims, 3 Drawing Sheets

IN-LINE ROLLER BLADE BRAKING DEVICE

BACKGROUND OF THE INVENTION

The present invention relates to sporting goods and more particularly, relates to a braking system for in-line roller skates.

In recent years, the use of in-line roller skates has proliferated and with their common usage, problems have been encountered. One major problem is the inadequacy of a braking system which in turn has led to accidents and injuries and in some municipalities, the use of the roller skates has been banned for safety reasons. Thus, the skates are used on the streets, sidewalks and bicycle paths and due to the free wheeling nature of the skates, even experienced skaters have difficulties avoiding unexpected obstacles.

The problem of braking of in-line roller skates has been recognized in the art and many different proposals for braking systems have been advanced. To date, the braking system in common use is a brake pad that is mounted on either the heel or toe of the skate and is dragged across the skating surface to enable direct frictional engagement between the pad and the skating surface. As will be appreciated, this system requires that the skater has good balance since the skater must tip the skate while in motion. In addition, since one requires frictional engagement between the pad and skating surface, there will be a variable rate of braking depending upon the particular surface involved. Still further, the skater can utilize the braking power of only a single skate at any one time thus again limiting the rate at which braking occurs. Still further, the amount of pressure which can be put on the brake pad is limited, either for a front brake pad arrangement brake pad or a heel brake pad arrangement.

It has also been proposed that one may have a mechanism which exerts a constant rolling resistance to the skate. Such devices are usually adjustable but are not suitable for the average skater who wants to achieve maximum speed with minimum effort while still having a braking capability.

There have also been proposals in the art for mechanical type brakes which have included various cable designs to ones using foot pressures on various locations to activate brakes. Thus, it has been proposed that the skater push downwardly with the heel (U.S. Pat. No. 5,232,231) to cause a boot rotation with respect to the frame of the skate and thereby transmit the force to brake shoes or pads. It has also been proposed in the art in U.S. Pat. No. 5,143,387 to provide for a braking system wherein the skater's toes are used in a curled position to activate a braking system. Naturally, in all systems which are activated by the foot of the skater, one must be cautious that the brakes would not be activated during normal skating maneuvers while still permitting the skater to brake on a moments notice.

It is an object of the present invention to provide a braking system for an in-line type of roller skate.

It is a further object of the present invention to provide an in-line roller skate braking system which operates on one or more of the wheels of the skate.

It is a further object of the present invention to provide a braking system for an in-line roller skate which can be operated on both skates at the same time.

SUMMARY OF THE INVENTION

It is a further object of the present invention to provide a braking system for in-line roller skates which can be operated by the foot of the skater.

It is a further object of the present invention to provide a braking system for in-line roller skates which system can remain activated while the skater performs maneuvers such as walking and stair climbing.

According to one aspect of the present invention, there is provided a braking system for in-line roller skates which include a plurality of wheels and a boot having a toe portion, the system comprising at least one brake member, the brake member being pivotably mounted and having a brake pad located thereon, the brake pad being moveable into and out of a braking relationship with the wheel, a moveable pressure plate mounted in the skate at the toe portion, the pressure plate being reciprocally moveable and having biasing means associated therewith, interconnecting means extending between the moveable pressure plate and the braking member such that when a force is applied to the pressure plate against the biasing means to move the pressure plate, the interconnecting means are operable to cause the brake member to pivot such that the brake pad engages a wheel in a braking relationship.

According to a further aspect of the present invention, there is provided a braking system for in-line roller skates which include a plurality of wheels and a boot having a toe portion, the system comprising caliper brakes operatively associated with at least one of the wheels, the caliper brakes being moveable into and out of a braking relationship with the wheels. The brakes are normally biased to a non braking position. A moveable pressure plate is mounted in the skate at the toe portion, the pressure plate being reciprocably moveable and includes biasing means associated therewith. Interconnecting means extend between the moveable pressure plate and the caliper brakes, the interconnecting means being such that when a force is applied to the pressure plate against the biasing means to move the pressure plate, the interconnecting means are operable to overcome the braking biasing means and to cause the brakes to move into a braking relationship with the wheel.

In greater detail, the breaking system of the present invention is designed to be utilized with most known types of in-line roller skates. Generally, the in-line skates comprise a boot having secured thereto by means of an appropriate structure a plurality of wheels mounted in a generally "in-line" configuration. The number of wheels may vary although four is the usual complement of wheels.

The braking system of the present invention is designed to be operable on at least one of the wheels although preferably the brakes are operable on both center wheels of the skate.

As will be shown in the preferred embodiments hereof, a preferred arrangement utilizes caliper brakes which are designed to apply a retarding force to the sides of the wheels. The material utilized for the brakes may be selected from any number of known materials. Those knowledgeable in the art could select from materials adapted to develop suitable friction forces between the wheel and the brake without damage to the wheels. Thus, one could use various plastics, rubbers, composites, metal alloys, etc. In a particularly preferred embodiment a disk-like member of a suitable material and preferably a metallic material is attached to the sides of the wheel and will function as a surface for the caliper brakes. This overcomes any problems associated with wheel wear.

A preferred design of the caliper brakes will include a pair of members which are interconnected by a suitable biasing member such as a spring to urge the brakes into a non braking relationship under normal conditions. In order to apply a braking force, preferably a cam member is operatively associated with the brake members to move them into a braking relationship. To this end, the braking members could be designed with a cam surface on which the cam member is operative.

The pressure plate is mounted in the toe region of the skate boot and preferably, is mounted in the sole of the boot such that a pressure by the toes functions to move the pressure plate. The pressure plate would include biasing means associated therewith to bias the plate in an upward direction. In one preferred embodiment, the biasing means functions that a greater pressure is required to initially depress the plate compared to the pressure or force required to maintain the plate depressed. Suitable means of so doing include compression springs and the like; one may also use Belleville springs or the equivalent. Preferably, the arrangement is such so as to prevent accidental engagement of the brakes during normal skating motions.

The means interconnecting the caliper brakes and the pressure plate and the means of transmitting the motion from the pressure plate to the brakes may be varied. In one embodiment, an inner connecting member may be pivotably mounted such that pressure from the pressure plate exerts a force on one end of the bar which then enters between the camming surfaces of the brakes to cause engagement thereof. Other equivalents including the use of gear type arrangements may also be incorporated.

Having thus generally described the invention, reference will be made to the accompanying drawings, illustrating an embodiment thereof, in which:

DETAILED DESCRIPTION OF THE INVENTION

Figure 1:
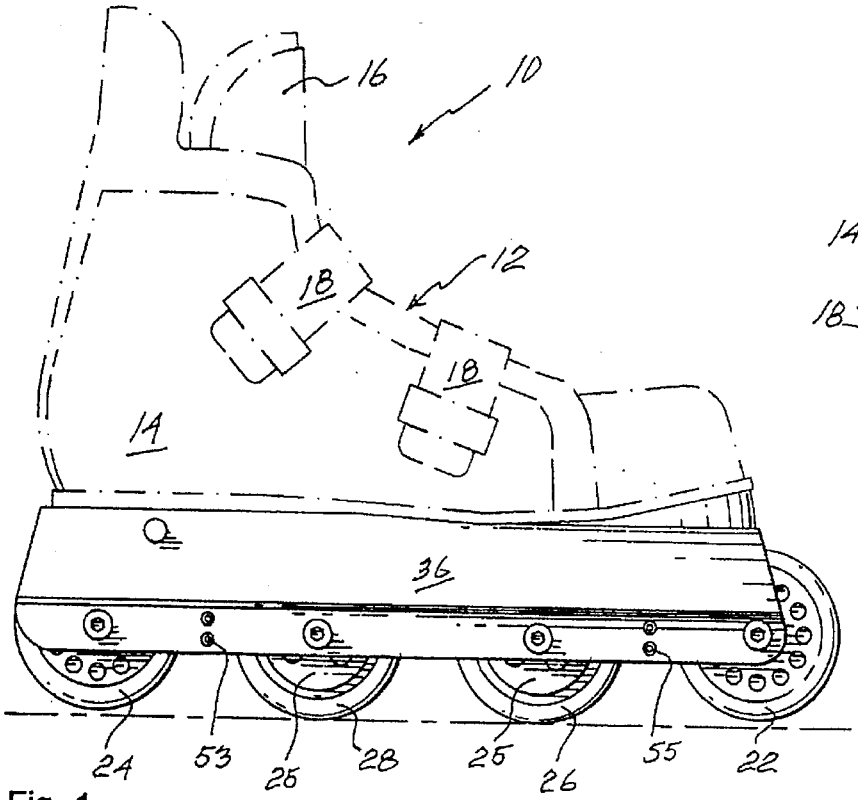
FIG. 1 is a side elevational view of an in-line roller skate incorporating the present invention.
Figure 2:
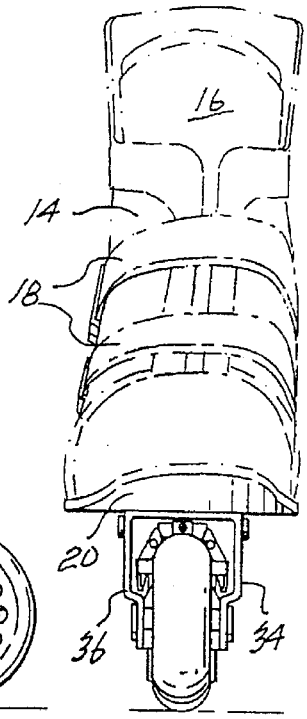
FIG. 2 is a front elevational view as seen from the right hand side of FIG. 1.

Referring to the drawings in greater detail and by reference characters thereto, there is illustrated in FIG. 1 an in-line roller skate or generally designated by reference numeral 10 and which includes a conventional type of boot 12 having a boot body 14, a boot sole 20, a tongue 16 and straps 18. The above is all a substantially conventional construction.

In-line skate 10 has a front wheel 22, a rear wheel 24, and a pair of center wheels 26 and 28. Center wheels 26 and 28 include a disk member 25 mounted on both sides (only one shown). A wheel mounting frame includes a base 32 secured to the bottom of boot sole 20 and a pair of downwardly extending side walls 34 and 36. Extending between walls 34 and 36 are a plurality of axles 38 for mounting wheels 22, 24, 26 and 28.

Figure 3:
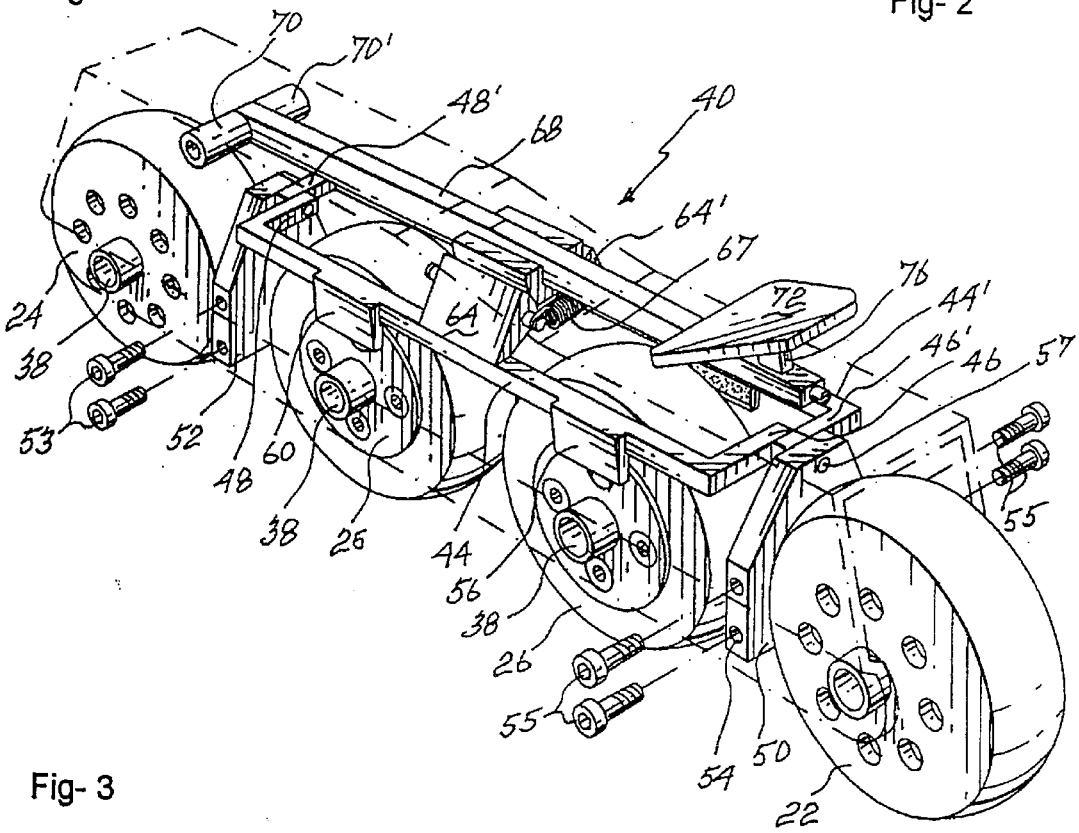
FIG. 3 is a perspective view of the wheels and braking system.
Figure 6:
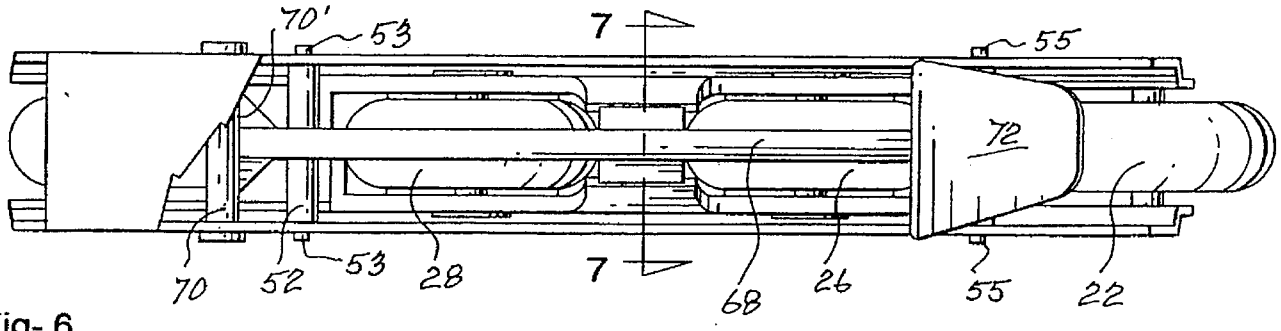
FIG. 6, is a top plan view, partially in cutaway of the braking system and wheels.

As shown in FIG. 3, there is provided a brake assembly generally designated by reference numeral 40 which is enclosed within the wheel mounting frame. Brake assembly 40 is substantially symmetrical about its longitudinal axis and detailed reference will be made to one side of the assembly with similar components on the other side being designated, where appropriate, by like reference numerals using a prime.

There is provided a U-shaped member comprising longitudinally extending element 44 having at each end thereof, an end arm 46 and 48. At the front, adjacent end arm 46 there is provided a mounting member 50 which extends between side walls 34 and 36 and is suitably secured thereto by screws 55 received in screw threaded apertures 54. Mounting member 50 is located to extend between front wheel 22 and center wheel 26.

Figure 8:
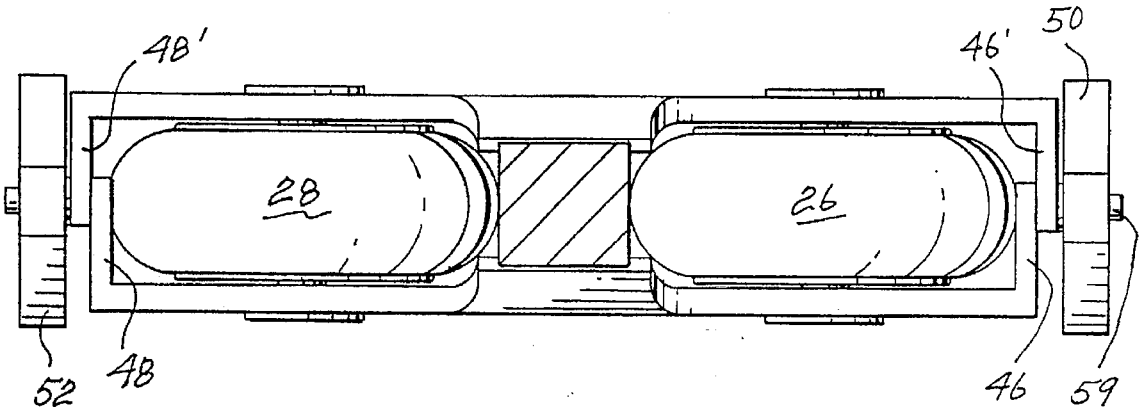
FIG. 8 is a sectional view taken along the lines 8—8 of FIG. 4.

Mounting member 50 also is adapted to mount arms 46, 46' and thus has an aperture 57 (FIG. 3) for receiving a screw 59 (FIG. 8). At the rear end of the skate, a similar mounting member 52 is likewise adapted to receive and mount end arms 48, 48' and is secured to side walls 34, 36 by screws 53.

Mounted on longitudinal elements 44 and 44' are brake pad holders 56, 56' each of which have a brake pad 58, 58' respectively. A similar brake pad holder 60 with an associated brake pad is provided adjacent center wheel 28.

Longitudinal elements 44 and 44' each have an upwardly extending portion 64, 64' which in turn has a cam surface 65, 65' associated therewith. Mounted intermediate cam surfaces 65, 65' is a cam member 66. Portions 64, 64' are secured together by a pair of spring members 67.

Extending longitudinally of the skate is an interconnecting member 68 which is connected to side walls 34 and 36 by transversely extending arm portions 70 and 70' at the rear end of interconnecting member 68.

At the forward end of force interconnecting member 68, there is provided a pressure plate 72 which is secured to interconnecting member 68 by means of a vertical post 76. Post 76 passes through an aperture within interconnecting member 68 and is held in a desired position by means of a set screw 77.

Figure 4:
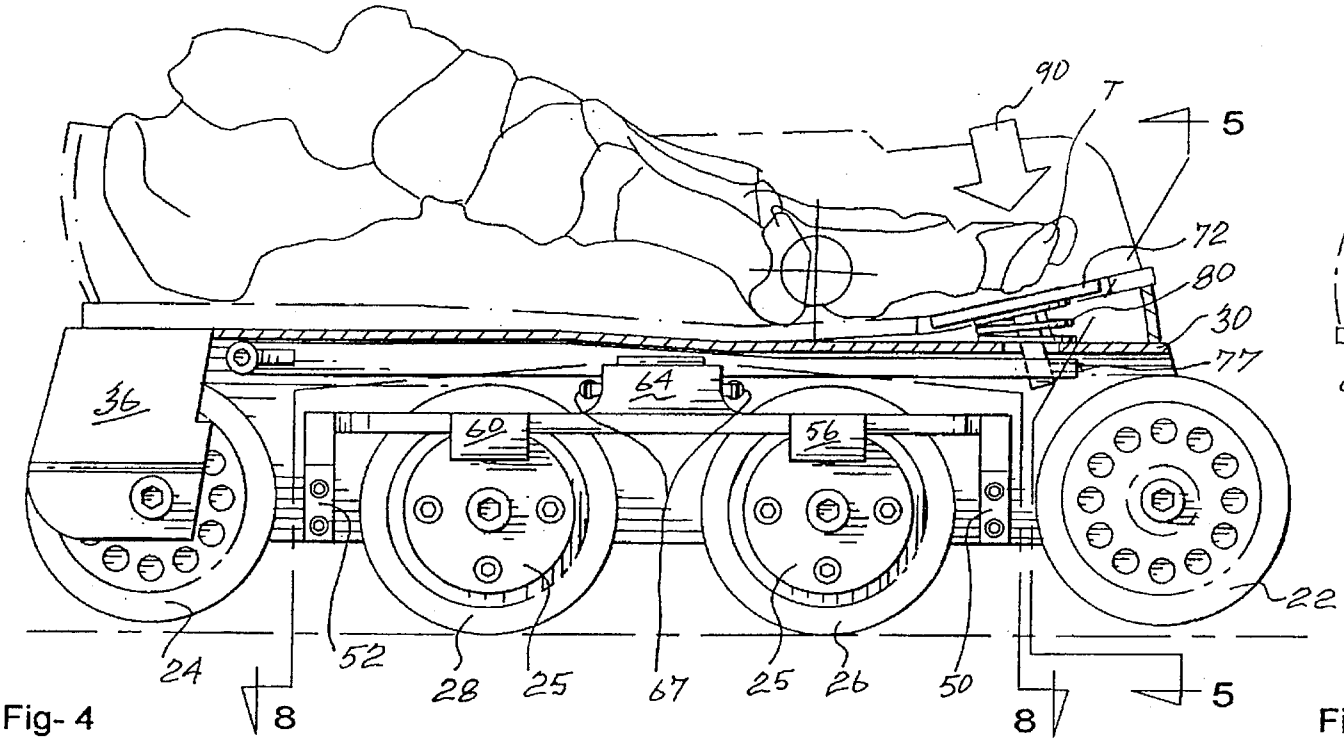
FIG. 4 is a side elevational view of the braking system showing the operation thereof.
Figure 5:
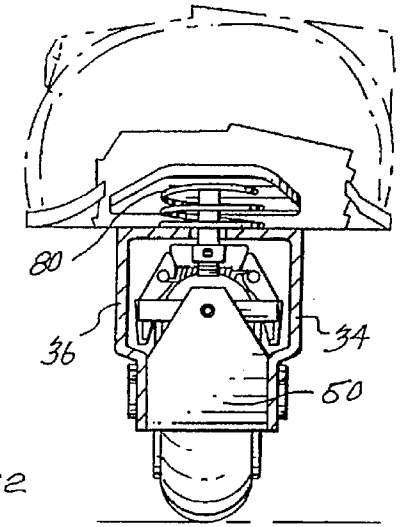
FIG. 5 is a sectional view taken along the lines 5—5 of FIG. 4.

As may best be seen in FIG. 4, pressure plate 72 is mounted within boot sole 20 and a compression spring 80 is mounted between the bottom of pressure plate 72 and base 32 of wheel mounting frame 30.

In operation, when it is desired to brake or exert a retarding force on the wheels, pressure by one or more toes T exert a force as indicated by arrow 90 on pressure plate 72 and will cause a downward movement to be exerted on interconnecting arm 68. This in turn will cause camming member 66 to act on camming surfaces 65, 65' to overcome the normal biasing force exerted by springs 67. Accordingly, longitudinal arms 44, 44' will pivot to cause brake pads 58 and its companion (not shown) to engage with the disks 25 on the sides of center wheels 26 and 28.

During normal operation, the toe or toes of the skater will not exert enough pressure to overcome the force on the spring. However, when desired, sufficient pressure can be exerted to overcome the spring pressure and thereby activate the brakes. As will be appreciated, the pressure required can be adjusted by means of set screw 77.

It will be seen that one could maintain the force on pressure plate 72 when walking or forming other maneuvers such as climbing stairs. This would overcome many of the problems otherwise associated with such movement.

Figure 7:
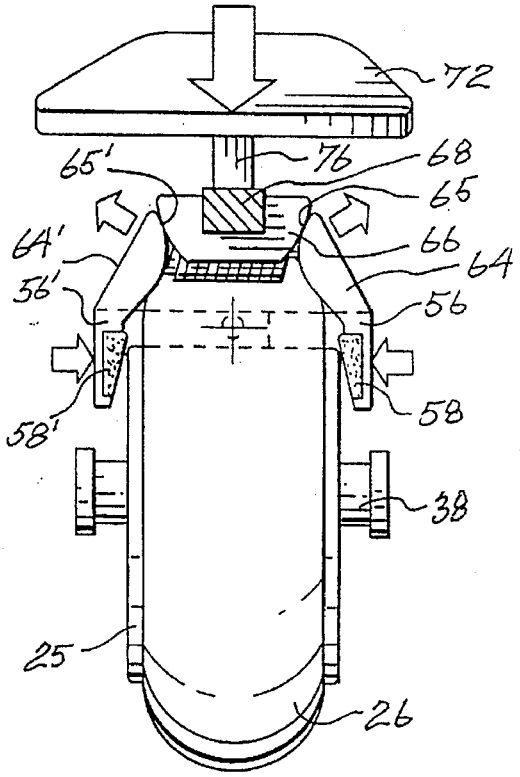
FIG. 7 is a sectional view taken along the lines 7—7 of FIG. 6.
Figure 7A:
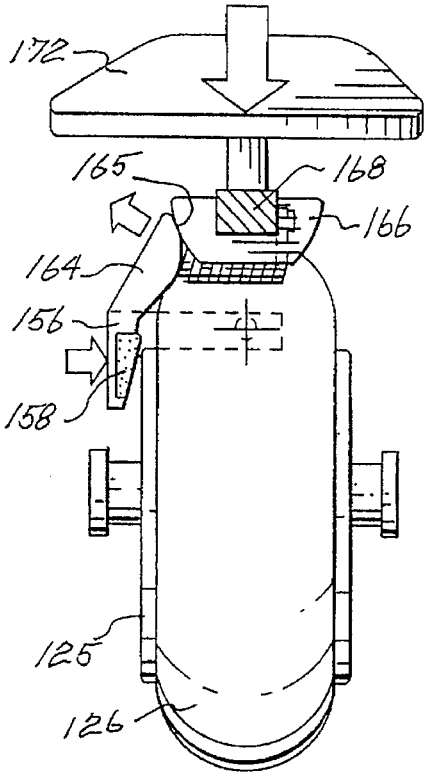
FIG. 7A is a view similar to FIG. 7 showing an alternative embodiment.

In an alternative embodiment illustrated in FIG. 7A, a single brake is utilized. In this embodiment, similar reference numerals in the 100's are utilized. As will be seen, interconnecting member 168 is adapted to press downwardly on cam member 166 which will in turn transmit force through camming member 166 and member 164 to cause brake pad 158 to be applied against disc 125 mounted on the side of wheel 126.

It will be understood that the above described embodiments are for purposes of illustration only and that changes and modifications may be made thereto without departing from the spirit and scope of the invention.

What is claimed is:

1. In an in-line roller skate having a plurality of wheels, a boot having a toe portion and a braking system, the improvement wherein said system comprises caliper brakes said brakes being pivotably mounted and having brake pads located thereon, said brake pads being moveable into and out of braking relationship with said wheel, a moveable pressure plate mounted in the skate at said toe portion, said pressure plate being reciprocably moveable and having a variable resistance biasing means associated therewith, interconnecting means extending between the moveable pressure plate and the brakes such that when a force is applied to said pressure plate against said biasing means to thereby move said pressure plate said interconnecting means are operable to cause said brakes to pivot such that said brake pads engages said wheel in a braking relationship, and means for adjusting the force required on said pressure plate to cause said pressure plate to move.

2. The improvement of claim 1 wherein said brakes are resiliently biased to a normally non-braking relationship with said wheel.

3. The improvement of claim 1 further including a disc member mounted on each side of said wheel, said brake pads being located so as to contact said disc member when in a braking position.

4. A In an in-line roller skate having a plurality of wheels, a boot with a toe portion, and a braking system, the improvement wherein said system comprises caliper brakes operatively associated with at least one of said wheels, said brakes being moveable into and out of a braking relationship with said wheel, a moveable pressure plate mounted in said skate at said toe portion, said pressure plate being reciprocably moveable in response to pressure thereon, biasing means associated with said pressure plate, and interconnecting means extending between said moveable plate and said brakes, said interconnecting means being adapted to move said caliper brakes into a braking position in response to movement of said pressure plate, and means for adjusting a force required to be exerted on said pressure plate to cause said pressure plate to move.

5. The improvement of claim 4 wherein said biasing means associated with said moveable pressure plate comprise a variable resistance biasing means.

6. The improvement of claim 4 wherein said caliper brakes are operatively associated with a plurality of said wheels.

7. The improvement of claim 5 wherein said interconnecting means comprises a member extending between said caliper brakes and said pressure plate, said member being pivotably connected such that a movement of said pressure plate causes said member to function as a cam on a camming surface of said brakes.

8. The improvement of claim 4 further including a disc member mounted on each side of said wheel, said brakes being adapted to contact said disc member when in a braking relationship.

9. The improvement of claim 8 wherein said disc member is formed of a metallic material.

* * * * *

UNITED STATES PATENT AND TRADEMARK OFFICE

CERTIFICATE OF CORRECTION

PATENT : 5,657,999

DATED : Aug. 19, 1997

INVENTOR(S) : Beaulieu

It is certified that error appears in the above-identified patent and that said Letters Patent is hereby corrected as shown below:

On the title page, under item [30] Foreign Application Priority Data, insert the following:

-- [30] July 26, 1994 [GB] Great Britain.....9415032--.

Signed and Sealed this

Fourth Day of May, 1999

*Attest:*

*Attesting Officer*

Q. TODD DICKINSON

*Acting Commissioner of Patents and Trademarks*